US006536115B2

(12) United States Patent
Tabbi et al.

(10) Patent No.: US 6,536,115 B2
(45) **Date of Patent: *Mar. 25, 2003**

(54) AUTOMATICALLY RETRACTABLE SAFETY UTILITY KNIFE

(76) Inventors: James Tabbi, 550 Phelps Rd., Honeoye Falls, NY (US) 14472; John E. Bernacki, 56 Gateway Rd., Rochester, NY (US) 14624; Christopher J. Hughson, 786 South Ave., Rochester, NY (US) 14620; James A. Herley, 18 W. Buffalo Rd., Churchville, NY (US) 14428

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/183,507

(22) Filed: Oct. 30, 1998

(65) Prior Publication Data

US 2002/0004985 A1 Jan. 17, 2002

Related U.S. Application Data

(60) Provisional application No. 60/063,844, filed on Oct. 31, 1997.

(51) Int. Cl.[7] ..... B26B 3/06

(52) U.S. Cl. ..... 30/162; 30/294; 30/317; 30/340

(58) Field of Search ..... 30/335, 162, 2, 30/294, 317, 340

(56) References Cited

U.S. PATENT DOCUMENTS 2,512,237 A * 6/1950 Mravik ..... 30/151
3,009,247 A * 11/1961 Mueller ..... 30/294
3,065,540 A * 11/1962 Magnatta ..... 30/162
3,337,955 A * 8/1967 Poletajev ..... 30/294
3,436,823 A * 4/1969 Lamb et al. ..... 30/335
3,478,427 A * 11/1969 Tims, Jr. ..... 30/294
3,943,627 A * 3/1976 Stanley, Jr. ..... 30/337
4,031,616 A * 6/1977 Hines et al. ..... 30/294
4,091,537 A * 5/1978 Stevenson, Jr. ..... 30/294
4,192,066 A * 3/1980 Tucker ..... 30/162
4,393,587 A * 7/1983 Kloosterman ..... 30/162
4,523,379 A * 6/1985 Osterhout et al. ..... 30/162
4,576,164 A * 3/1986 Richeson ..... 30/162
4,663,846 A * 5/1987 Takayama ..... 30/162

(List continued on next page.)

*Primary Examiner*—Allan N. Shoap
*Assistant Examiner*—Stephen Choi
(74) *Attorney, Agent, or Firm*—Stephen B. Salai, Esq.; Roger Aceto, Esq.; Harter, Secrest & Emery LLP

(57) ABSTRACT

The present invention provides a knife with a replaceable blade which is spring-biased in the retracted position. The knife is designed such that the blade can only be extended by exerting a downward force and by turning the handle with respect to an inner housing. The handle has a tab affixed to the inside wall of the handle. The inner housing has an angled slot in its wall adapted to receive the tab. When the blade is fully retracted, the tab rests on the shoulder at the top of the inner housing. A straight downward pressure on the handle causes the tab to engage the shoulder and will not allow the blade to extend. When the handle is rotated, the tab enters the slot and the blade is forced downward. As this occurs, the blade extends through a slot at the bottom of a blade cover. When the blade is removed from the object to be cut, the spring forces the handle to move with respect to the inner housing and causes the blade to retract within the blade cover. The handle has a longitudinal axis which is between 1 degree and 35 degrees from the line perpendicular to the bottom surface of the blade cover. In this position, the operator holds the handle with his thumb and forefinger at the end of the handle opposite the blade.

9 Claims, 8 Drawing Sheets

U.S. PATENT DOCUMENTS 4,730,613 A * 3/1988 Gordy ..... 30/162
4,735,202 A * 4/1988 Williams ..... 30/162
4,813,141 A * 3/1989 Funger ..... 30/290
5,181,320 A * 1/1993 Tucciarone ..... 30/294
5,292,329 A * 3/1994 Werner ..... 30/162
5,353,508 A * 10/1994 Baker ..... 30/294
5,391,177 A * 2/1995 Schwartz ..... 30/162
5,545,175 A * 8/1996 Abidin et al. ..... 30/162
5,561,906 A * 10/1996 Desmarais ..... 30/317
5,665,099 A * 9/1997 Pilo et al. ..... 30/162
5,740,614 A * 4/1998 Carder et al. ..... 30/293
5,881,463 A * 3/1999 Casteel et al. ..... 30/294

* cited by examiner

AUTOMATICALLY RETRACTABLE SAFETY UTILITY KNIFE

This application claims priority from U.S. Provisional Patent Application, Serial No. 60/063,844 filed Oct. 31, 1997.

BACKGROUND OF THE INVENTION

1. Field of the Invention

The present invention relates generally to a knife and more particularly pertains to a knife wherein the blade is automatically retracted when the knife is not being used.

2. Description of the Related Art

It is generally recognized that a utility knife presents a danger to the operator due to the sharpness of the blade in the knife protruding from the handle. One approach for reducing the danger has been to provide knives which permit a manual retraction of the blade into the handle of the knives. A common form of such a knife includes a blade which has a thumb-actuated slide mechanism to extend and retract the blade.

U.S. Pat. No. 4,393,587 to Kloosterman, the disclosure of which is incorporated by reference, discloses a utility knife having an automatically retracting blade. In this patent, there is an outer cylindrical handle, an inner cylindrical blade cover, and the blade holder. The blade holder is attached to the outer cylindrical handle which is spring-biased fully from the inner cylindrical blade cover. When a compressive force is exerted on the outer handle, the blade is extended. While this invention is an improvement of the art, it has a significant drawback. Any time a compressive force is exerted on the handle, the blade will extend. Therefore, if the operator inadvertently presses the knife against a part of his body, the blade may extend and cause injury. A utility knife is needed in which the blade may not be inadvertently extended.

In addition, the knife of Kloosterman has another significant drawback. The blade guide and handle are oriented with respect to one another such that the operator's hand must be in an uncomfortable position to operate the knife. In the device of Kloosterman, the handle and a line perpendicular to the blade guide are at an angle of approximately 45 degrees with respect to one another. In this position, the knife must be held with the thumb and forefinger adjacent the blade. This results in an uncomfortable hand position. A utility knife is also needed which allows the user to operate the knife in a ergonomically desirable position.

SUMMARY OF THE INVENTION

The present invention overcomes the deficiencies of utility knives of the past. The invention includes an automatically retracting blade on a utility knife which requires a dual action of the hand to extend the blade. The utility knife of the present invention also is designed such that the operator may hold the knife in the ergonomically optimal position.

The present invention provides a knife with a replaceable blade which is spring-biased in the retracted position. An outer generally cylindrical housing is provided which acts as a handle for the knife. An inner, generally cylindrical housing is provided which is slidably mounted within the outer housing. The knife is designed such that the blade can be extended only by simultaneously exerting a downward force and turning the outer handle with respect to the inner housing. The handle has an internal shoulder member which extends toward the center of the housing. The inner housing also has an internal shoulder member which extends toward the center of the housing. The shoulder of the inner housing has an axial bore.

A blade support member is adapted to hold a blade at a first end and at a second end extends through the bore and the shoulder member of the inner housing. The second end of the blade support member is trapped between the shoulder member of the outer housing and a second shoulder member attached to the outer housing. The space between the inner housing shoulder member and the outer housing shoulder member contains a spring adapted to telescopically bias the outer housing away from the inner housing. The outer housing has a tab affixed to the inside wall thereof. The inner housing has an angled slot in its wall adapted to receive the tab. When the blade is fully retracted, and the outer housing is rotated with respect to the inner housing, the tab rests on the shoulder at the top of the inner housing. In this position, the slot is angularly offset from the tab such that a straight downward pressure on the outer housing causes the tab to engage the shoulder and will not allow the blade to extend. When the outer housing is counter-rotated and the pressure is overcome, the tab enters the slot and the blade support member is forced downward with respect to the inner housing displacing the blade downwards. A blade cover provided at the bottom of the inner housing includes a bottom surface with a slot therein. As the blade is displaced, the cutting tip of the blade extends through the slot at the bottom of the blade cover such that the operator may use the blade for cutting objects. When the blade is removed from the object to be cut, and downward pressure on the handle is relieved, the spring forces the handle to move telescopically with respect to the inner housing and causes the blade to be retracted within the blade cover.

The outer housing has a longitudinal axis which is between 1 degree and 35 degrees from the line perpendicular to the bottom surface of the blade cover; preferably the angle is about 15 degrees. In this position, the operator holds the handle with his thumb and forefinger at the end of the handle opposite the blade. In prior art designs, the angle between the perpendicular to the cutting surface and the handle is such that the handle is oriented on the side of the perpendicular opposite the blade and adjacent the operator. In the present invention, the handle is on the same side of the perpendicular as the blade and opposite the operator. In other words, in the present invention the handle is angled away from the operator. The prior art designs are such that the handle is angled toward the operator. This design of the present invention enables the operator to hold the knife in the thumb-up position as shown in FIG. 8. In this position, the wrist of the operator is at a natural and ergonomically optimal position. In knives of the prior art, the knife is held such that the thumb and forefinger are at the end of the handle adjacent the blade. In this position, the wrist of the operator is in an unnatural position and over time, may result in repetitive stress injury such as carpal tunnel syndrome.

DESCRIPTION OF THE PREFERRED EMBODIMENT

Figure 1:
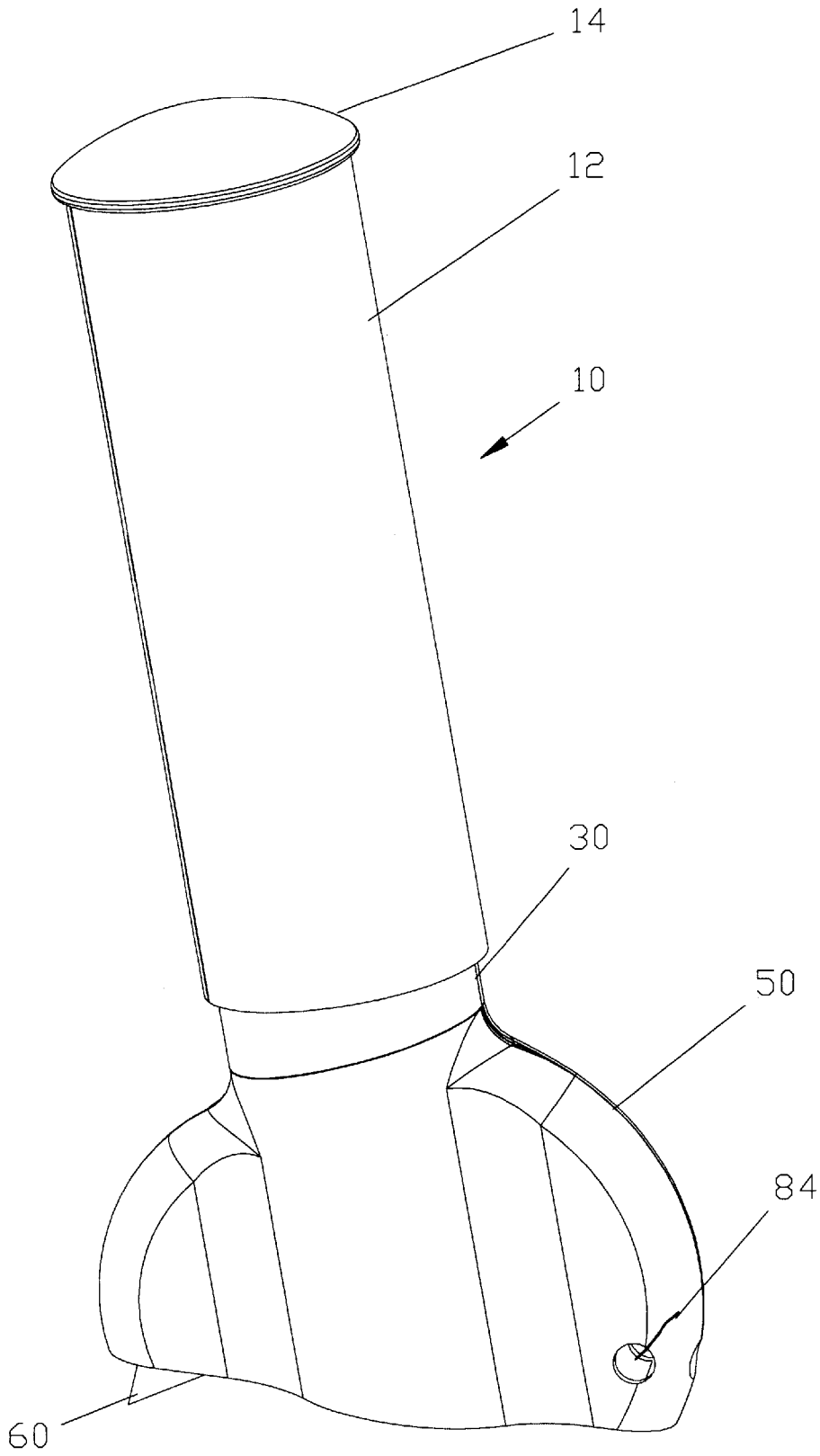
FIG. 1 is a perspective view of a knife in accordance with the invention, showing the blade extended into cutting position.
Figure 2:
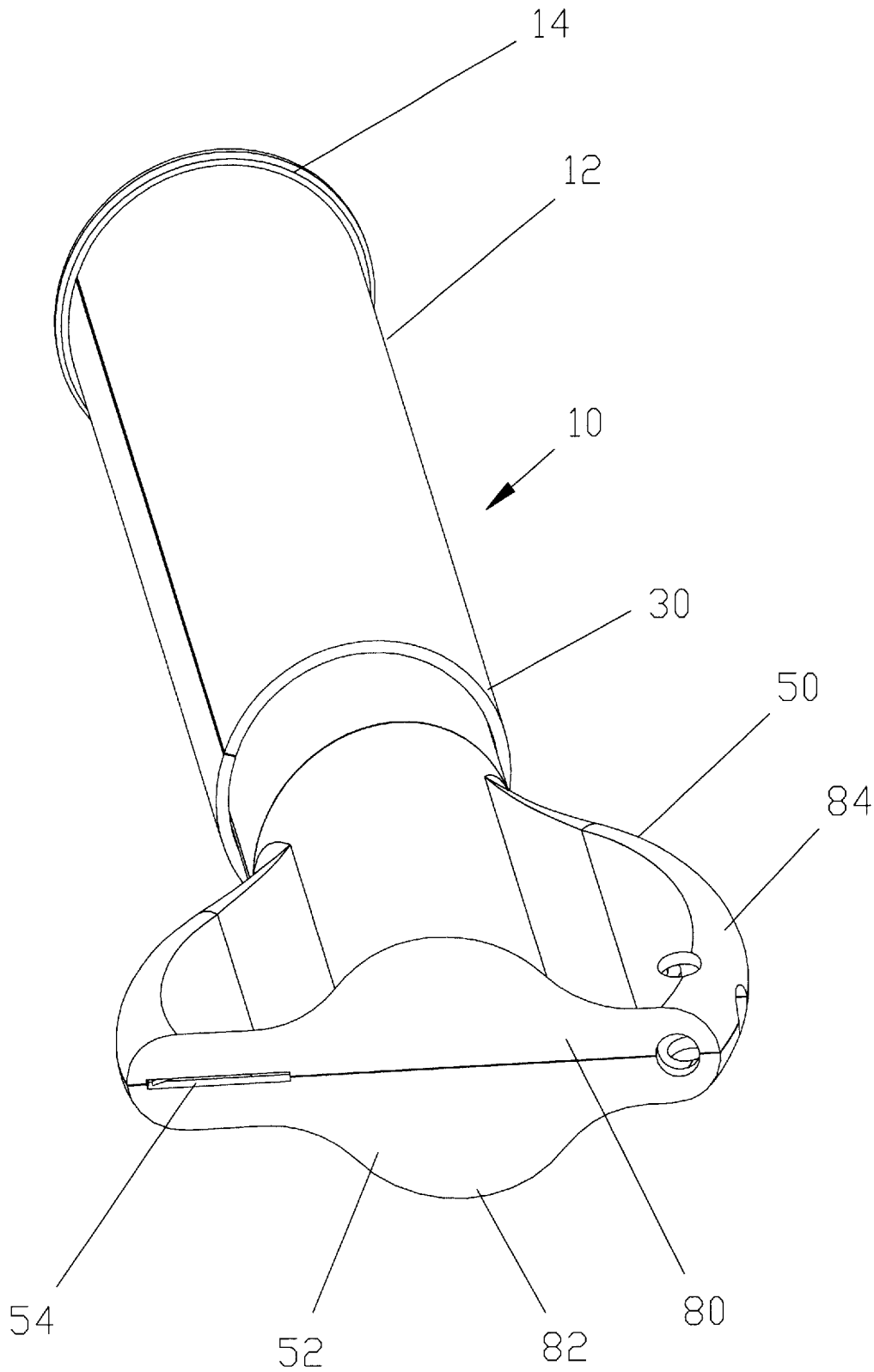
FIG. 2 is a perspective view of the underside of the knife shown in FIG. 1, showing the knife sole and a slot therein for extension and retraction of the knife blade show in FIG. 1.
Figure 3:
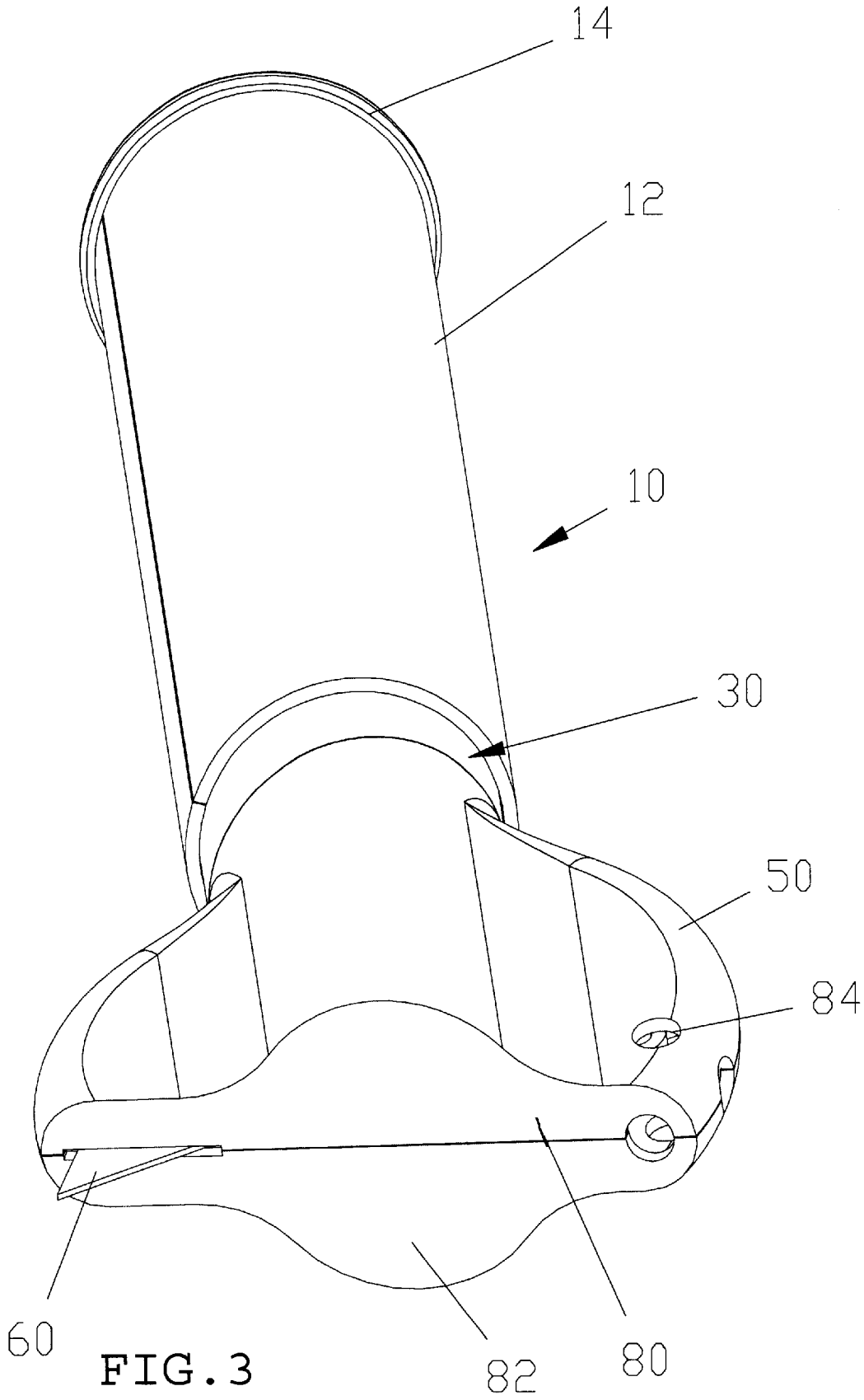
FIG. 3 is a view like that shown in FIG. 2, showing the knife blade extended through the slot.

Referring to the drawings and in particular to FIG. 1, a knife 10 is provided having an outer housing or handle 12 which is generally cylindrical in shape and has a hollow interior portion. It will be understood by those skilled in the art that other shapes of outer housings are possible such as rectangular, oval or any other shape suitable for being held by the human hand. The handle 12 may be constructed from plastic, steel, aluminum or any other suitable material. The handle has an end cap 14 at the top thereof. An inner housing 30 is provided which is slidably retained within the handle 12. A blade cover 50 is provided which is attached to the inner housing 30.

Turning to FIGS. 4–7, the inner workings of the knife 10 are shown. A blade support member 20 is adapted to hold a blade 60 at one end thereof in a receptacle 23 of conventional construction. At the other end of the blade support member 20 is a first stop member 22. The outer housing has a first shoulder member 24 adapted to prevent the upward movement of first stop member 22. A second stop member 26 limits the extent of movement of the blade support in the opposite direction. Thus, stop member 22 is trapped between stop members 24 and 26. The second stop member 26 has a bore therein 28 through which the blade support member projects. The inner housing 30 is also constructed of suitable material such as plastic or metal. The inner housing 30 has a second shoulder member 33. A spring 70 is disposed between the second stop member 26 and second shoulder member 33. The spring forces the outer housing 12 telescopically away from the inner housing 30 in the axial direction thereof. The blade cover 50 is adapted to hold the blade 60 therein in a conventional manner. The blade may be of any suitable configuration, but is preferably a standard double-ended utility blade. The blade cover 50 has a bottom surface or sole 52 with a slot 54 therein.

Figure 4:
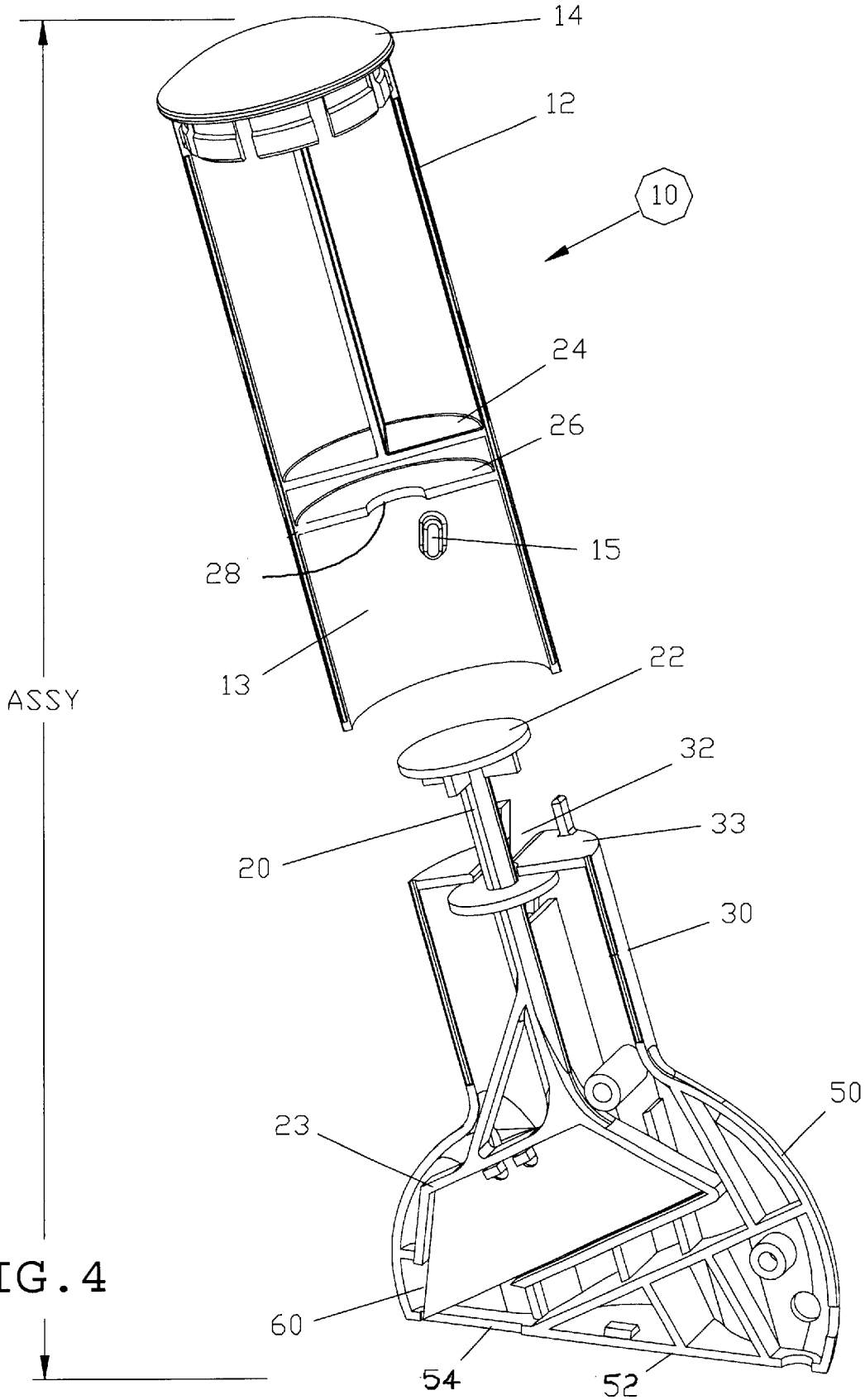
FIG. 4 is an exploded cutaway view, showing the outer handle and the inner housing and blade cover.
Figure 5:
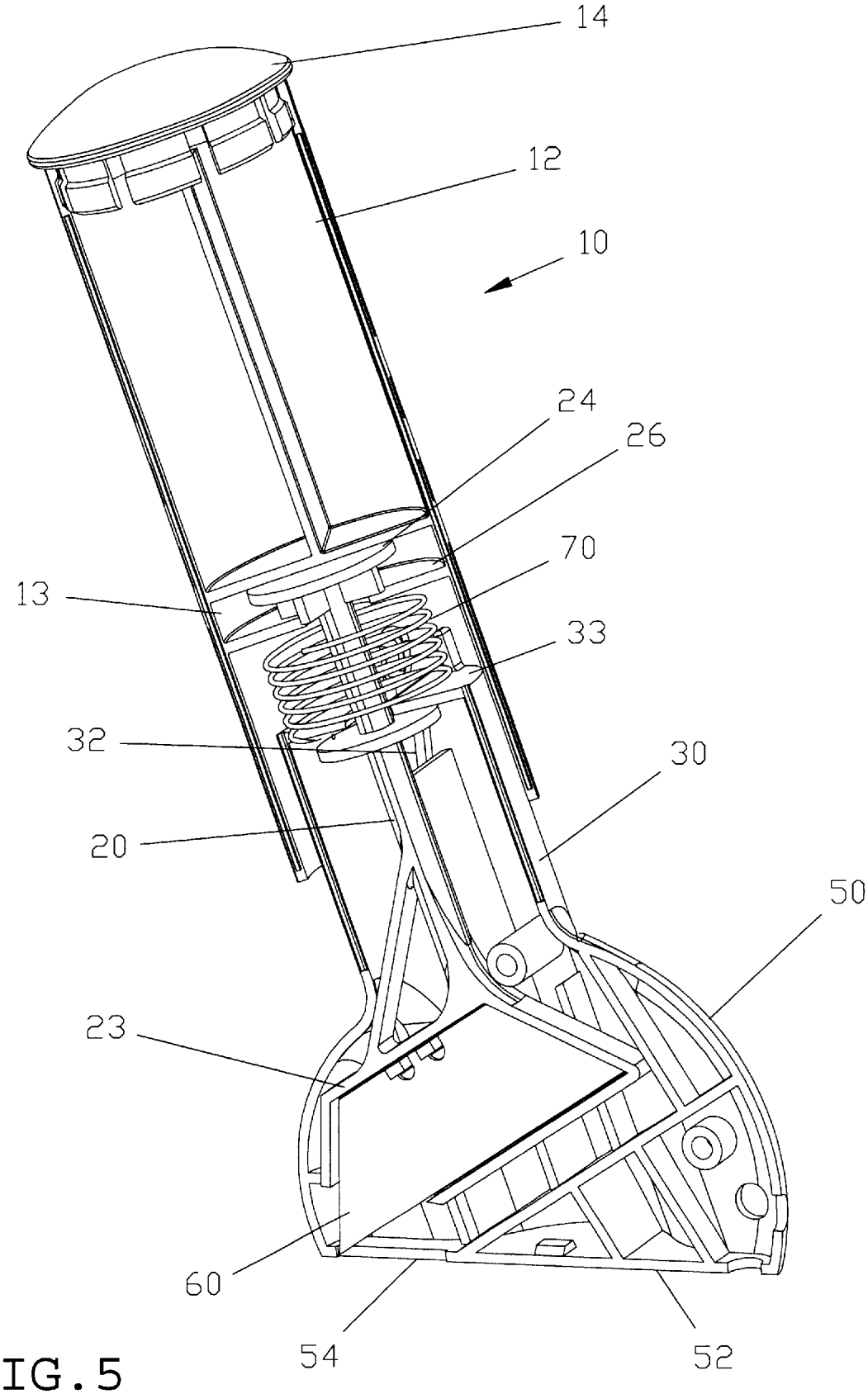
FIG. 5 is a cross-sectional view, showing a knife in blade-retracted mode.
Figure 6:
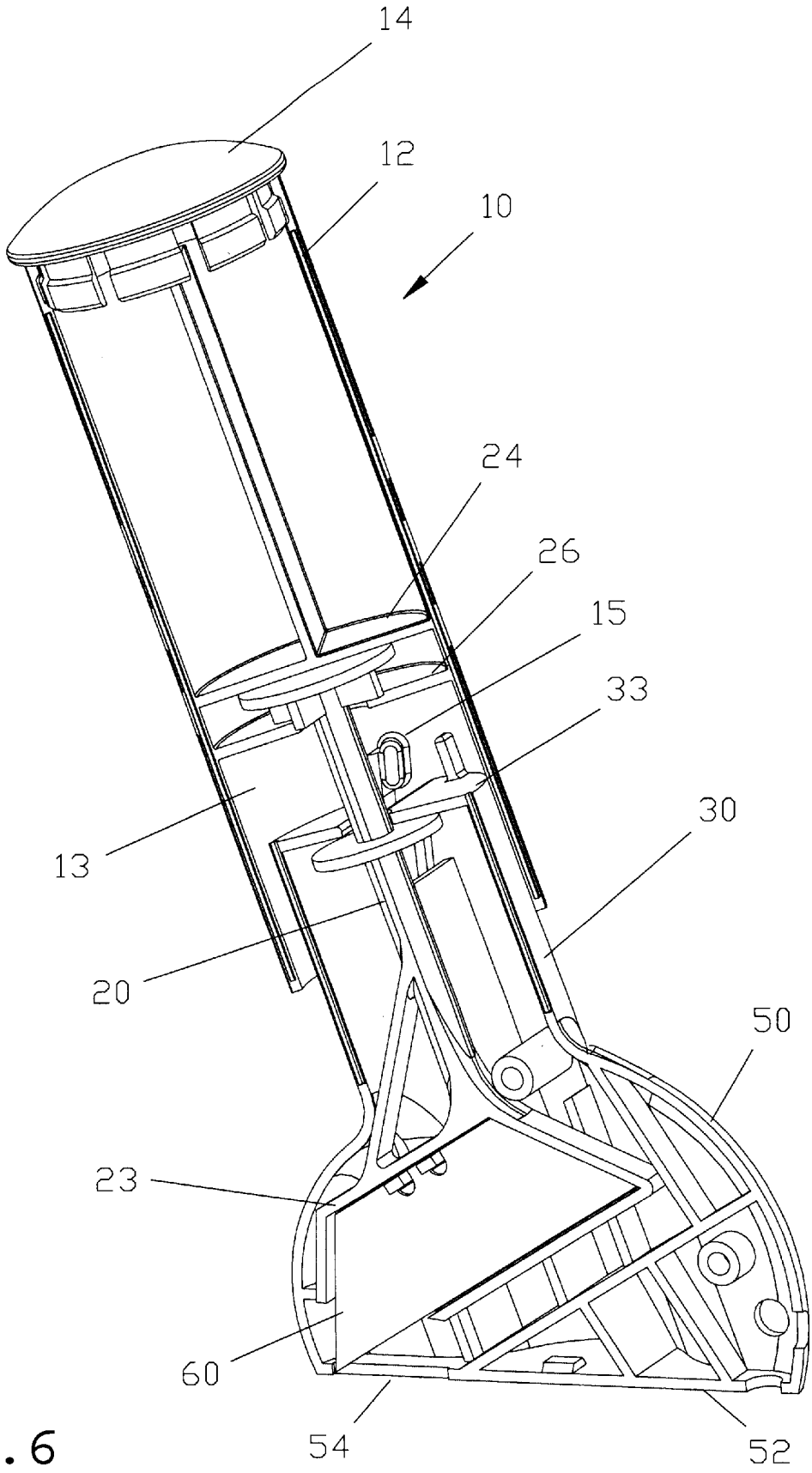
FIG. 6 is a perspective cutaway view with the retracting spring omitted for clarity, showing a safety mechanism for locking the knife in blade-retracted mode.
Figure 7:
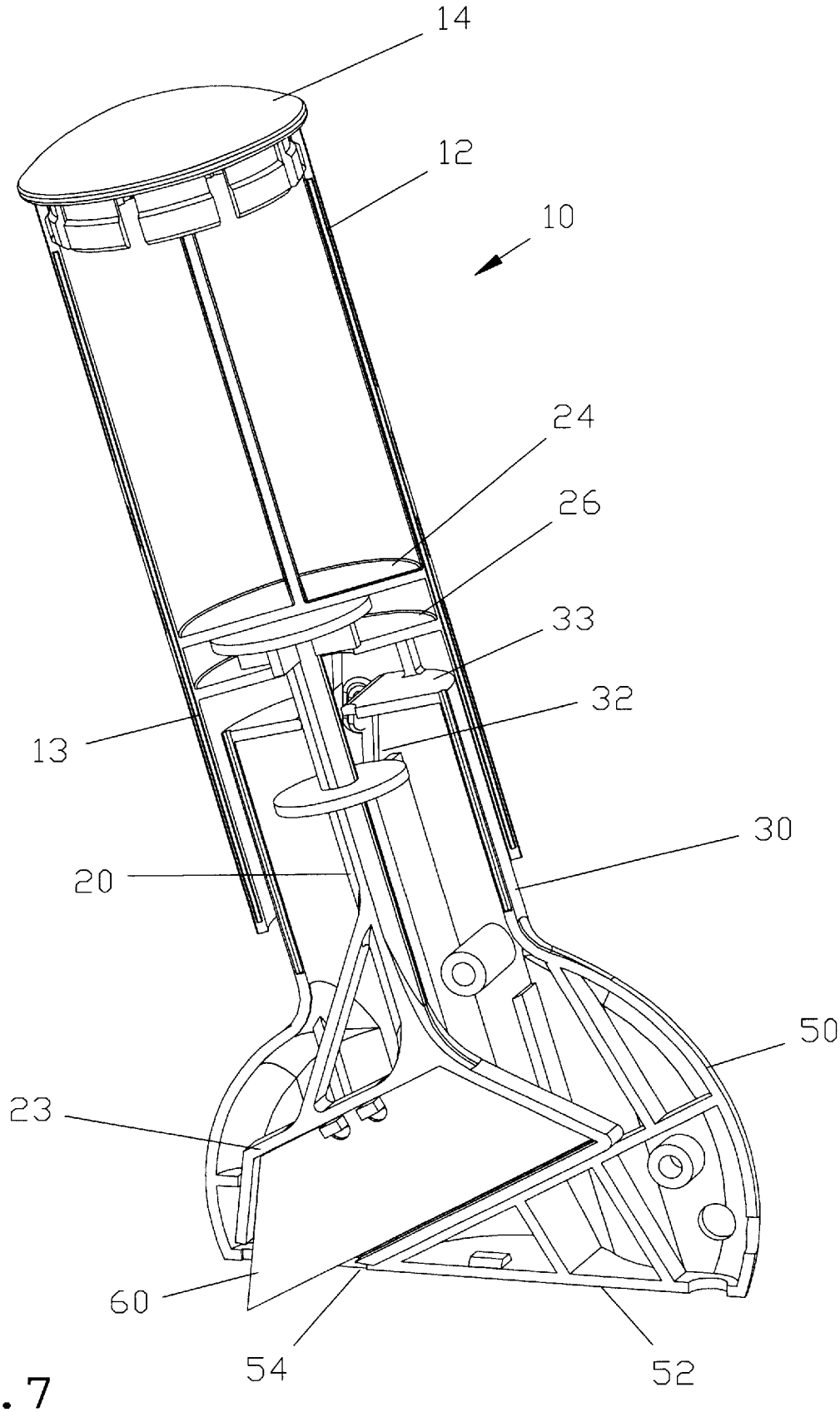
FIG. 7 is a view like that shown in FIG. 6, showing unlocking of the safety mechanism by rotation of the handle relative to the knife body.

As shown in FIGS. 4,6, and 7, the inner wall 13 of the handle 12 has a tab 15 attached thereto. The inner housing 30 has a slot 32 therein. When the blade 60 is retracted, tab 15 rests on the shoulder 33. A straight downward pressure on the outer housing 12 causes the tab to strike the shoulder 33 and prevents the downward motion of the blade 60. When the outer housing is rotated with respect to the inner housing 30, the tab 15 enters the slot 32 and the blade will extend through the slot 54 in the bottom surface 52 of the blade cover 50. When the bottom surface 52 is removed from the object being cut and downward pressure on handle 12 is relieved, the spring forces the inner housing 30 away from the handle 12. Because the blade support 20 is trapped between the two shoulders 24 and 26, the blade 60 moves in the direction of the handle 12. As this occurs, the blade is pulled in through the slot 54 and is safely retracted within the blade cover 50.

The blade cover 50 preferably includes two halves, 80 and 82 which are held together by a snap fit feature. When the two halves are pulled apart, the blade 60 may be replaced with a new blade, after the blade 60 has reached the end of its useful life. The blade cover includes holes 84 to permit hanging on a peg board.

Figure 8:
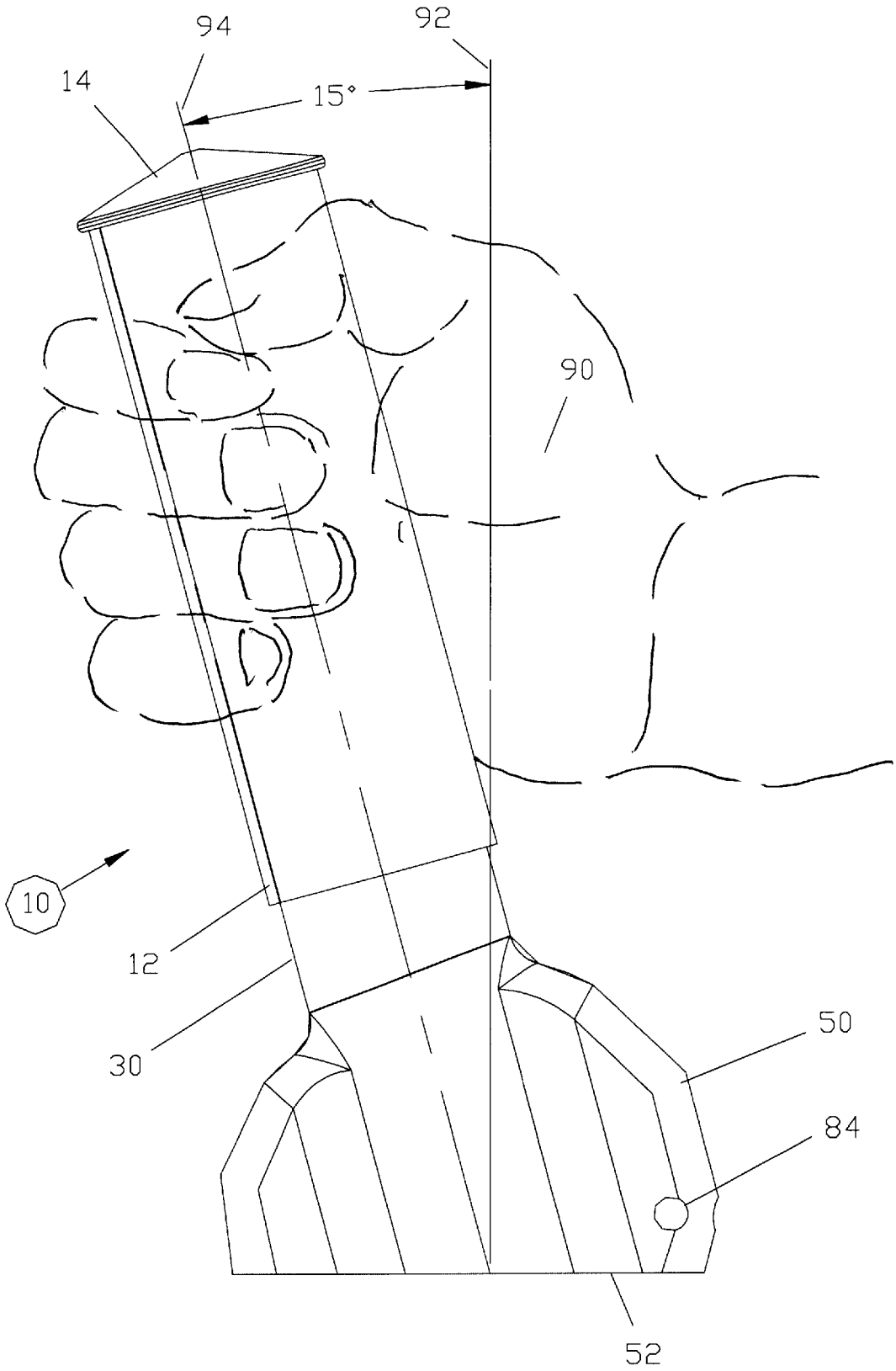
FIG. 8 is an elevational view of a knife in the grasp of a user.

Turning to FIG. 8, the knife 10 and operator's hand 90 are shown. A line 92 perpendicular to the bottom surface 52 and a longitudinal axis 94 of the handle 12 form an angle θ. The angle θ is between 1 degree and 35 degrees and is preferably approximately 15 degrees. As illustrated, the endcap 14 is angled away from the operator and the operator's hand is in the thumb-up position.

The foregoing is illustrative only of the principles of the invention. Further, since numerous modifications and changes will readily occur to those skilled in the art, it is not desired to limit the invention to the exact construction and operation shown and described, and accordingly, all suitable modifications in the equivalence may be resorted to, falling within the scope of the invention.

What is claimed is:

1. A shielded safety knife for cutting an object comprising:

a) a handle for permitting a user to grip the knife, said handle having a hollow interior portion defined by an inner wall;

b) a blade support having a knife blade attached thereto at one end and having a second end attached to said handle;

c) an inner housing slidably and rotatably received within said handle hollow interior portion, said inner housing being telescopically movable relative to said handle between a first position wherein said knife blade is retracted into said inner housing and a second position wherein a portion of said knife blade extends from said inner housing and is exposed for cutting;

d) cooperating aligned members on said inner housing and inner wall respectively preventing the exposure of said knife blade portion by preventing said inner housing from telescopically moving from said first position to said second position; and e) said handle being rotable with respect to said inner housing to de-align said cooperating aligned members to permit the telescopic movement of said inner housing to said second position.

2. A shielded safety knife as in claim 1 including a blade cover attached to said inner housing for enclosing said blade, said blade cover having a bottom surface arranged to press against the object to be cut and a slot in said bottom surface through which said knife blade portion is extended and retracted.

3. The apparatus of claim 2 wherein said blade cover comprises two sides removably attached to one another such that said blade is replaced by separating said sides to permit access to said blade.

4. The apparatus of claim 2 wherein said knife blade is arranged on said blade support for cutting by drawing the knife in a cutting direction towards the user with the bottom surface of the blade cover pressed against the object to be cut, said handle having a longitudinal axis disposed at an angle with respect to said bottom surface and angled away from the user and opposite to the cutting direction, and wherein a line perpendicular to said bottom surface of said blade cover is at an angle of between 1 degree and 35 degrees with respect to said longitudinal axis.

5. The apparatus of claim 4 wherein said angle is between 10 degrees and 25 degrees.

6. The apparatus of claim 5 wherein said angle is approximately 15 degrees.

7. The apparatus of claim 1 wherein said handle is cylindrical.

8. The apparatus of claim 1 further including a stop for preventing the extension of said blade beyond a preselected distance.

9. A shielded safety knife as in claim 1 wherein said bias means is a helical spring.

* * * * *

UNITED STATES PATENT AND TRADEMARK OFFICE

CERTIFICATE OF CORRECTION

PATENT NO. : 6,536,115 B2
DATED : May 27, 2003
INVENTOR(S) : Tabbi et al.

It is certified that error appears in the above-identified patent and that said Letters Patent is hereby corrected as shown below:

Column 4,
Line 36, after paragraph (e), please insert the following:
-- (f) bias means between said handle and inner housing for urging said inner housing to the first position. --

Signed and Sealed this

Ninth Day of September, 2003

JAMES E. ROGAN
*Director of the United States Patent and Trademark Office*